US007503793B2

(12) United States Patent
Morello

(10) Patent No.: US 7,503,793 B2
(45) Date of Patent: Mar. 17, 2009

(54) ELECTRICAL CONNECTOR BODY HAVING A TRANSVERSE HOLD-DOWN BEAM FOR A SHROUD-INTEGRATED LOCK ARM

(75) Inventor: John R. Morello, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/654,861

(22) Filed: Jan. 18, 2007

(65) Prior Publication Data

US 2008/0176436 A1 Jul. 24, 2008

(51) Int. Cl.
*H01R 13/627* (2006.01)

(52) U.S. Cl. ..... 439/352; 439/358

(58) Field of Classification Search ..... 439/352, 439/358, 357, 350, 353
See application file for complete search history.

(56) References Cited

U.S. PATENT DOCUMENTS

| | | | | |
|---|---|---|---|---|
| 5,378,168 | A * | 1/1995 | Sumida | 439/358 |
| 6,419,515 | B1 * | 7/2002 | Okayasu | 439/358 |
| 6,461,056 | B1 * | 10/2002 | Besler et al. | 385/76 |
| 6,896,524 | B1 | 5/2005 | Morello et al. | |

* cited by examiner

*Primary Examiner*—Neil Abrams
*Assistant Examiner*—Phuong Nguyen
(74) *Attorney, Agent, or Firm*—David Wood

(57) ABSTRACT

A socket connector body includes a shroud adapted to receive a plug connector body, and also includes a lock arm integrally connected to the shroud and having a free end with an inwardly extending lock nib. The socket connector body further includes a transverse hold-down beam integrally connected to the shroud and being adapted to impose a hold-down force on the free end of the lock arm when the lock arm is pivoted from its free state of rest.

6 Claims, 2 Drawing Sheets

ELECTRICAL CONNECTOR BODY HAVING A TRANSVERSE HOLD-DOWN BEAM FOR A SHROUD-INTEGRATED LOCK ARM

FIELD OF THE INVENTION

This invention relates generally to electrical connectors and more particularly to electrical connector bodies having connector locks.

BACKGROUND OF THE INVENTION

Typical low profile electrical socket connectors include a socket connector body including a terminal housing, a shroud surrounding the terminal housing, and an integral lock arm defined by slots through the shroud. The lock arm includes two sets of straps to integrally connect the lock arm to the shroud. A first set of the straps torsionally biases the lock arm toward a free state of rest and enables the lock arm to resiliently pivot with respect to the shroud. A second set of the straps are located at a forward end of the connector to stabilize the lock arm. The lock arm has an inwardly extending lock nib located midway between the first and second sets of integral connector portions, and a depressible handle at a rearward end of the connector.

A plug connector body can be plugged into the socket connector body within the shroud, wherein the lock nib of the lock arm rides over and snaps behind a lock shoulder of the plug connector body. To unplug the plug connector body, a user depresses the lock arm handle to pivot the lock arm about its first set of integral connector portions. This action raises the lock nib out of engagement from behind the lock shoulder so that the plug connector body can be pulled out of the shroud. These socket connectors are generally satisfactory, but can be too bulky for some applications.

SUMMARY OF THE INVENTION

A socket connector body includes a shroud adapted to receive a plug connector body, and also includes a lock arm integrally connected to the shroud and having a free end with an inwardly extending lock nib. The socket connector body further includes a transverse hold-down beam integrally connected to the shroud and being adapted to impose a hold-down force on the free end of the lock arm when the lock arm is pivoted from its free state of rest. The size of the lock arm and body can be reduced because of this additional hold-down force.

DETAILED DESCRIPTION OF THE PREFERRED EMBODIMENTS

Figure 1:
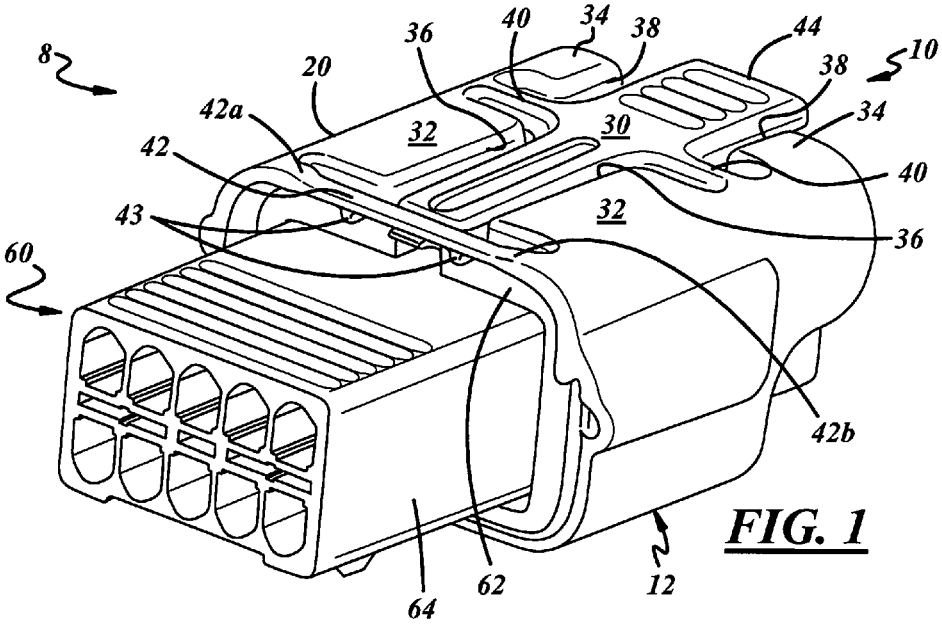
FIG. 1 is a perspective view of a connector assembly including a plug connector body received in a socket connector body.

Referring now to FIG. 1, an electrical connector assembly 8 includes a plug connector 60 received within a socket connector 10. The plug connector 60 can carry any suitable electrical terminals (not shown) and, likewise, the socket connector 10 can carry any suitable electrical terminals (not shown). When the plug connector 60 is seated and locked within the socket connector 10, the corresponding electrical terminals of the connectors 10, 60 connect with one another.

Figure 2:
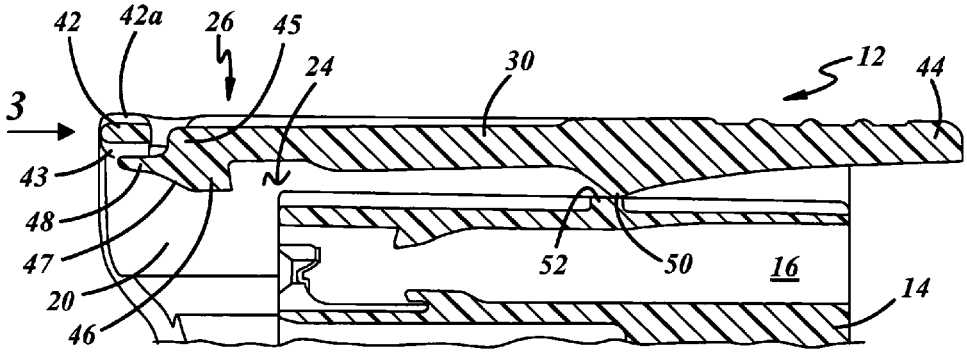
FIG. 2 is a partial cross-sectional view of the socket connector body of FIG. 1.
Figure 3:
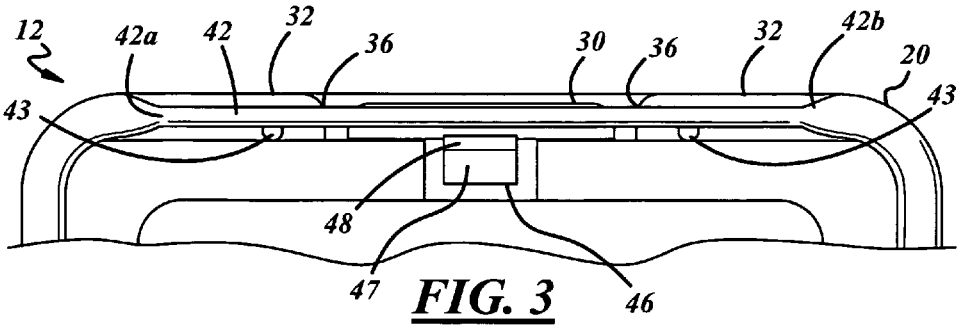
FIG. 3 is a front view of the socket connector body of FIG. 2, taken along line 3 thereof.

Referring to FIGS. 1 through 3, the socket connector 10 includes a connector body 12 having a terminal housing 14 defining terminal cavities 16 extending through the terminal housing 14 for receiving electrical terminals therein. The connector body 12 also has a shroud 20 that at least partially surrounds the terminal housing 14, and can be integrally or separately connected to the terminal housing 14 in any suitable manner. The shroud 20 defines a socket 24 for receiving the plug connector 60.

The connector body 12 also includes a connector lock 26 for retaining the plug connector 60 in the socket 24. The connector lock 26 is incorporated into the shroud 20 of the connector body 12 so as to provide a relatively low profile socket connector. The connector lock 26 includes a longitudinally extending lever, latch, or lock arm 30 that is formed out of forward and rearward exterior wall portions 32, 34 of the shroud 20. While the exterior wall 32, 34 of the shroud 20 is illustrated as being generally rectangular in transverse cross-sectional profile, the exterior wall 32, 34 can be any other suitable shape, such as round, square, oval, or elliptical.

As best shown in FIG. 1, the lock arm 30 is defined by forward and rearward pairs of through slots 36, 38 that extend through the forward and rearward exterior wall portions 32, 34. The forward pair of through slots 36 extends through the forward portion 32 and the rearward pair of through slots 38 extends through the rearward portion 34 of the shroud 20. Both pairs of through slots 36, 38 have longitudinal parts and transverse parts so that the two pairs of through slots 36, 38 cooperatively define resilient straps 40 that connect the lock arm 30 to the remainder of the exterior wall 32, 34 of the shroud 20. Although the straps 40 are resilient, they are suitably strong to support typical connector retention forces, and they torsionally bias the lock arm 30 toward a free state of rest as shown in FIG. 2. The rearward through slots 38 are generally L-shaped so that the rear end of the arm 30 forms a depressible handle 44 that is free of the rearward exterior wall portion 34 of the shroud 20. Preferably, the handle 44 extends beyond the rear edge of the shroud wall portion 34. Also, the forward pair of through slots 36 is preferably generally U-shaped so that there are second forward transverse parts that define a transverse hold-down beam 42

Referring to FIGS. 1 through 3, the transverse hold-down beam 42 defines a front or leading edge of the shroud 20, and can be suspended between laterally opposed fixed ends 42*a*, 42*b* integrally connected to the shroud 20. In any case, the hold-down beam 42 is inherently resilient in that it is molded to be normally biased in an inward direction. Accordingly, the hold-down beam 42 provides a means to impose a hold-down force on the lock arm 30 when the lock arm 30 is pivoted from its free state of rest, so as to bias the lock arm 30 down (i.e. back toward its free state of rest). The hold-down beam 42 can also include guides 43 for guiding the plug connector 60 under the beam 42 and into the shroud 20. The guides 43 assure that a front edge of the mating plug connector 60 will not directly collide with and catch on the lock arm 30. Rather, the guides 43 will deflect the forward edge of the mating plug connector 60 under the lock arm 30 to prevent the mating plug connector 60 from becoming caught between the beam 42 and the lock arm 30.

As best shown in FIG. 2, the lock arm 30 has a free end 45 including an inwardly extending lug, pawl, or lock nib 46 for locking engagement with the plug connector 60, and a nib ramp 47 for engaging the front edge of the plug connector 60 to raise the lock arm 30. The free end 45 can also include a hold-down engagement pad 48 that extends forwardly and is disposed inwardly of the transverse hold-down beam 42, such that a gap is defined therebetween when the socket connector body 12 is in its free state of rest, as shown in FIGS. 2 and 3. The gap can allow mold tooling to pass therethrough during molding of the body 12.

Figure 4:
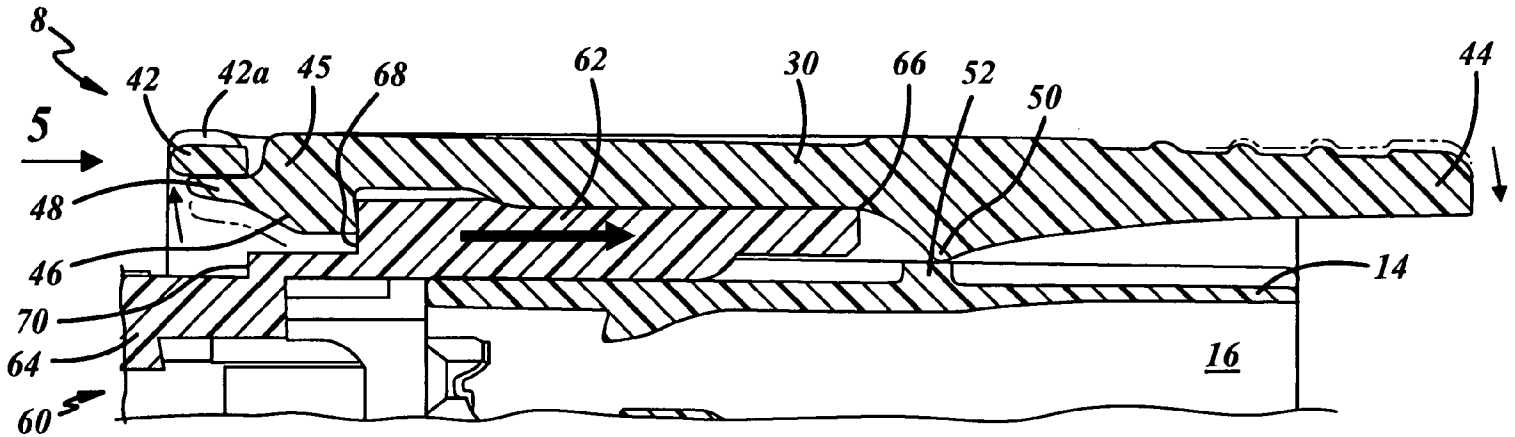
FIG. 4 is a partial cross-sectional view of the connector assembly of FIG. 1.
Figure 5:
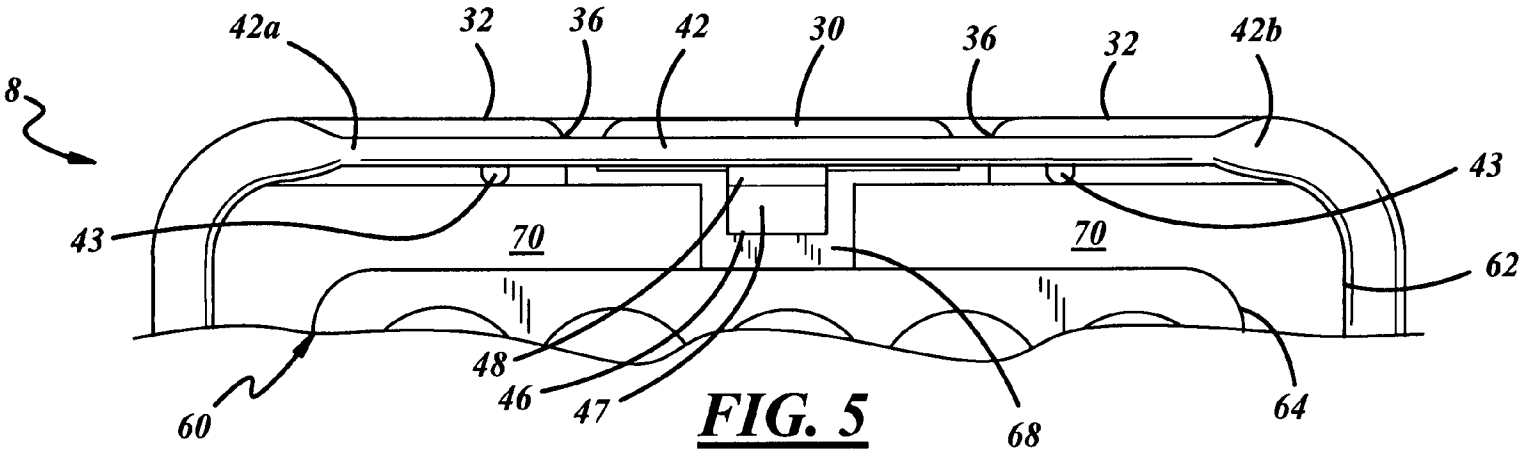
FIG. 5 is a front view of the connector assembly of FIG. 1, taken along line 5 thereof.

But preferably, as indicated in FIGS. 4 and 5, when the plug connector 60 is received and locked in place to the socket connector 10, the hold-down beam 42 contacts the engagement pad 48 of the lock arm 30 to impose a bias force thereon. Finally, the lock arm 30 has an inwardly extending fulcrum 50, and the terminal housing 14 has a fulcrum reaction pad 52 substantially aligned and adapted to cooperate with the fulcrum 50 to facilitate outward pivoting of the free end 45 of the lock arm 30.

In use, the socket connector 10 mates with the plug connector 60, which includes a forward plug portion 62 that plugs into the socket 24 of the socket connector 10, and a rearward terminal housing portion 64. Because of the flexibility of the lock arm 30 and the straps 40, the lock arm 30 can pivot when the ramp 47 of the lock nib 46 rides over a front edge 66 of the plug connector 60. But because the lock arm 30 is internally torsionally biased toward its free state of rest, the lock nib 46 eventually snaps behind a lock shoulder 68 of the plug connector 60 when the plug portion 62 of the plug connector 60 is suitably plugged into the socket 24. The lock nib 46 thus retains the plug portion 62 of the plug connector 60 in the socket 24. In this configuration, the hold-down beam 42 preferably contacts the free end 45 of the lock arm 30, such as at the engagement pad 48 as shown, and imposes an external compressive hold-down force on the free end 45 of the lock arm 30 so as to maintain the lock nib 46 in engagement behind the lock shoulder 68 of the plug connector 60. The use of the hold-down beam 42 can provide a suitable hold-down force to enable a reduction in the size of the lock arm 30 and, thus, the entire connector body 12.

To unplug the plug connector 60, the handle 44 is depressed manually, thereby causing the fulcrum 48 to engage the fulcrum reaction pad 52 and raise the free end 45 of the lock arm 30 outwardly away from the plug connector 60 against the bias force of the hold-down beam 42. Accordingly, the lock nib 46 is moved out of engagement with the lock shoulder 68 of the plug connector 60, and the hold-down beam 42 is raised so that the guides 43 clear a shoulder 70 of the plug connector 60 such as a rear surface of the forward plug portion 62. The plug connector 60 then can be unplugged or pulled out of the socket connector 10.

In contrast to conventional electrical connectors, the socket connector of the present invention does not require a lock arm having bulky ribbing for strength and for reducing bending along the length of the lock arm. Also, the present invention socket connector does not require bulky protective rails extending relatively high above a lock arm.

In contrast to prior low profile electrical connectors having shroud-integrated lock arms, the socket connector of the present invention enables location of a lock nib at a free end of a lock arm for cooperation with a hold-down beam for improved lock arm hold-down force. In other words, the socket connector provides an improved means to impose a hold-down force on the lock arm at the free end thereof closer to the lock nib to enhance locking action of the socket connector to a mating plug connector. Accordingly, the increased hold-down force for a given socket connector enables the size of that socket connector to be reduced to an even lower profile than was heretofore possible. The socket connector also enhances plug insertion performance by way of the guides on the hold-down beam. Further, for some applications there may be no need for use of cable protection rails due to the reduction in connector size the present invention provides. Also, the present invention socket connector enables a lock arm to be tilted in its molded position to allow mold tooling to pass between a free end of a lock arm and a hold-down beam.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

I claim:

1. A socket connector body comprising:

a shroud adapted to receive a plug connector body;

a lock arm integrally connected to the shroud and including a free end including an inwardly extending lock nib; and a transverse hold-down beam integrally connected to the shroud and being adapted to impose a hold-down force on the free end of the lock arm when the lock arm is pivoted from its free state of rest, wherein the lock arm is at least partially defined by forward and rearward pairs of slots through an exterior wall of the shroud to provide a relatively low profile connector body, and wherein the transverse hold-down beam is suspended between fixed ends and includes guides that are located between the fixed ends of the transverse hold-down beam and that project from the transverse hold down beam.

2. A socket connector body comprising:

a shroud adapted to receive a plug connector body;

a lock arm integrally connected to the shroud and including a free end including an inwardly extending lock nib; and a transverse hold-down beam integrally connected to the shroud and being adapted to impose a hold-down force on the free end of the lock arm when the lock arm is pivoted from its free state of rest, wherein the lock arm is at least partially defined by forward and rearward pairs of slots through an exterior wall of the shroud to provide a relatively low profile connector body, and wherein the lock arm includes an inwardly extending fulcrum having a free end that cooperates with a fulcrum reaction pod to facilitate outward pivoting of the free end of the lock arm and a depressible handle disposed rearwardly of the fulcrum.

3. A socket connector adapted to receive a plug connector, comprising:

a socket connector body including:

a terminal housing;

a shroud at least partially surrounding the terminal housing and being adapted to receive a plug connector body for connection with the terminal housing;

a longitudinally extending lock arm integrally connected to the shroud and including:

transversely extending resilient straps to integrally connect the lock arm to the shroud and to internally torsionally bias the lock arm toward a free state of rest;

a free end including an inwardly extending lock nib for engagement with the plug connector body;

a depressible handle disposed rearward of the resilient straps wherein the lock nib is movable outwardly away from the plug connector body when the depressible handle is depressed to enable release of the plug connector; and an inwardly extending fulcrum located between the lock nib and the depressible handle; and a transverse hold-down beam integrally connected to the shroud between fixed ends and being adapted to externally impose a compressive hold-down force on the free end of the lock arm to maintain the lock nib in engagement with the plug connector body.

4. A plug and socket connector assembly, comprising:

a plug connector body including a lock shoulder;

a socket connector body for receiving the plug connector body and including:

a terminal housing including a fulcrum reaction pad;

a shroud at least partially surrounding the terminal housing and being adapted to receive the plug connector body for connection with the terminal housing;

a longitudinally extending lock arm integrally connected to the shroud and including:

transversely extending resilient straps to integrally connect the lock arm to the shroud and to internally torsionally bias the lock arm toward a free state of rest;

a free end including an inwardly extending lock nib disposed forward of the resilient straps for engagement with the lock shoulder of the plug connector body;

a depressible handle disposed rearward of the resilient straps wherein the lock nib is movable outwardly away from the lock shoulder of the plug connector body when the depressible handle is depressed to enable release of the plug connector body from the socket connector body; and an inwardly extending fulcrum located between the lock nib and the depressible handle and adapted to contact the fulcrum reaction pad of the terminal housing; and a transverse hold-down beam suspended between fixed ends integrally connected to the shroud and including guide elements therebetween, and being adapted to externally impose a hold-down force on the free end of the lock arm to maintain the lock nib in engagement with the lock shoulder of the plug connector body.

5. A socket connector body comprising:

a shroud adapted to receive a plug connector body;

a lock arm that is formed out of forward and rearward exterior wall portions of the shroud, the lock arm being integrally connected to the shroud and including a free end including an inwardly extending lock nib; and a transverse hold-down beam integrally connected to the shroud and being adapted to impose a hold-down force on the free end of the lock arm when the lock arm is pivoted from its free state of rest, and wherein the lock arm is at least partially defined by forward and rearward pairs of slots through an exterior wall of the shroud to provide a relatively low profile connector body.

6. The socket connector body of claim 5, wherein the shroud is substantially rectangular in transverse cross-sectional profile, wherein each one of the forward pairs of slots are U-shaped and each one of the rearward pairs of slots are L-shaped.

* * * * *